US007244536B2

(12) United States Patent
Tachi et al.

(10) Patent No.: US 7,244,536 B2
(45) Date of Patent: Jul. 17, 2007

(54) TONER

(75) Inventors: Hidenori Tachi, Wakayama (JP); Shinji Moriyama, Wakayama (JP); Yoshihiro Fukushima, Wakayama (JP); Yasuyuki Tamane, Neyagawa (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/145,714

(22) Filed: May 16, 2002

(65) Prior Publication Data

US 2003/0059699 A1 Mar. 27, 2003

(30) Foreign Application Priority Data

May 16, 2001 (JP) ..... 2001-146936

(51) Int. Cl.
*G03G 9/08* (2006.01)

(52) U.S. Cl. ..... 430/108.23; 430/108.2; 430/108.4; 430/108.6

(58) Field of Classification Search ..... 430/106.2, 430/108.6, 108.2, 108.21, 108.23, 108.4, 430/108.3

See application file for complete search history.

(56) References Cited

U.S. PATENT DOCUMENTS

| | | | | | |
|---|---|---|---|---|---|
| 4,108,786 | A | * | 8/1978 | Takayama et al. | 430/106.2 |
| 4,146,494 | A | * | 3/1979 | Hectors et al. | 430/106.2 |
| 4,224,396 | A | * | 9/1980 | Pollet | 430/106.2 |
| 4,298,672 | A | * | 11/1981 | Lu | 430/108.2 |
| 5,215,850 | A | * | 6/1993 | Tsubota et al. | 430/108.2 |
| 5,262,264 | A | | 11/1993 | Shimizu et al. | |
| 5,290,650 | A | * | 3/1994 | Shintaku et al. | 430/108.2 |
| 5,378,571 | A | * | 1/1995 | Macholdt et al. | 430/108.2 |
| 5,663,027 | A | * | 9/1997 | Kohri et al. | 430/106.2 |
| 6,007,957 | A | * | 12/1999 | Kobori et al. | 430/106.2 |
| 6,130,017 | A | | 10/2000 | Hayashi et al. | |
| 6,248,492 | B1 | * | 6/2001 | Tavernier et al. | 430/108.6 |
| 2003/0054276 | A1 | * | 3/2003 | Moriyama et al. | 430/106.2 |

FOREIGN PATENT DOCUMENTS

| | | | | |
|---|---|---|---|---|
| JP | 62-2272 | A | | 1/1987 |
| JP | 03071148 | A | * | 3/1991 |
| JP | 4-60645 | A | | 2/1992 |
| JP | 4-195165 | A | | 7/1992 |
| JP | A-4-356059 | | | 12/1992 |
| JP | A-5-19536 | | | 1/1993 |
| JP | A-9-25126 | | | 1/1997 |
| JP | 10-246985 | A | | 9/1998 |
| JP | 10-293424 | A | | 11/1998 |
| JP | 11-24304 | A | | 1/1999 |
| JP | 11-24314 | A | | 1/1999 |
| JP | A-2000-10344 | | | 1/2000 |
| JP | 2000-275911 | A | | 10/2000 |
| JP | 2001-42571 | A | | 2/2001 |
| JP | 2001-92188 | A | | 4/2001 |
| JP | 2001-109201 | A | | 4/2001 |
| JP | 2002-169337 | A | | 6/2002 |
| JP | 2002-268281 | A | | 9/2002 |
| JP | 2002-278144 | A | | 9/2002 |

OTHER PUBLICATIONS

BASF Technical Information: SICOCER F (May 2000) pp. 1-5, 18, 19.*

Diamond, Arthur S. (editor) Handbook of Imaging Materials. New York: MArcel-Dekker, Inc. (1991) pp. 169-170.*

SICOCER F, Technical Information. Black 2904 (May 2004).*

* cited by examiner

*Primary Examiner*—Christopher Rodee
(74) *Attorney, Agent, or Firm*—Birch, Stewart, Kolasch & Birch, LLP

(57) ABSTRACT

A toner comprising a resin binder, a black colorant comprising a composite oxide of two or more metals, and a charge control agent comprising a quaternary ammonium salt. The toner is suitably used for the development of a latent image formed in electrophotography, electrostatic recording method, electrostatic printing method or the like.

14 Claims, No Drawings

TONER

BACKGROUND OF THE INVENTION

1. Field of the Invention

The present invention relates to a toner used for the development of a latent image formed in electrophotography, electrostatic recording method, electrostatic printing method or the like.

2. Discussion of the Related Art

Conventionally, carbon blacks have been widely used as a black colorant for a toner. However, the following problems have been addressed. Specifically, the toner containing carbon black has a low resistance, so that an appropriate level of triboelectric charge properties cannot be obtained, whereby deteriorations in image qualities such as unevenness of solid images and toner scattering are likely to be generated. Especially in a high-speed machine for a two-component development having a linear speed exceeding 370 mm/sec, a centrifugal force applied to the toner by a magnet roller is greater than the Coulomb's force between the toner and the carrier, so that there arises a phenomenon in which a toner is dropped in lumps to a so-called non-image bearing portion (hereinafter referred to as a "toner drop"). Especially in a high-printing mode in which printed ratio exceeds 20%, the toner consumption is rapid, so that the toner cannot have a sufficient level of triboelectric charges, whereby the toner drop becomes more remarkable.

In addition, in a monocomponent development, since the frictional triboelectric charging time is very short, the toner containing carbon black cannot have a sufficient level of triboelectric charges. Therefore, there arises undesired phenomena such that the fixed images are blurred during solid-image printing, and that the background fogging is likely to take place.

Various raw materials which are used in place of carbon black as black colorants have been studied. For instance, Japanese Patent Laid-Open No. Hei 4-356059 (U.S. Pat. No. 5,262,264) and Hei 5-19536 disclose a black toner comprising a yellow pigment, a mazenta pigment and a cyan pigment, without containing carbon black. In addition, Japanese Patent Laid-Open No. 2000-10344 (U.S. Pat. No. 6,130,017) and Japanese Patent Laid-Open No. Hei 9-25126 disclose toners comprising various composite oxides. However, even when the three pigments are mixed together, an appropriate degree of blackness cannot be obtained, and the triboelectric charges are also unstable. In addition, although the inclusion of the latter composite oxide contained in a toner gives the toner a high triboelectric charge, it is deficient in the stability of the triboelectric charges. Also, since the degree of blackness is also slightly lower, there arises a problem of lowering the fixing ability when the composite oxide is contained in a large amount in a toner.

An object of the present invention is to provide a toner having excellent stability and initial rise in the triboelectric charges, thereby continuously giving an excellent fixed image without generating deterioration in the image quality even when the toner is applied to a high-speed machine for a two-component development or to a developing device for a nonmagnetic monocomponent development.

These and other objects of the present invention will be apparent from the following description.

SUMMARY OF THE INVENTION

According to the present invention, there is provided a toner comprising:

a resin binder, a black colorant comprising a composite oxide of two or more metals, and a charge control agent comprising a quaternary ammonium salt.

DETAILED DESCRIPTION OF THE INVENTION

One of the greatest features of the toner of the present invention resides in that the toner comprises a composite oxide and a quaternary ammonium salt. Since the toner comprises a specified combination of the composite oxide and the quaternary ammonium salt, there are exhibited some effects that an appropriate level of the triboelectric charges of the toner can be stably maintained, and that its fixing ability is not deteriorated even when the composite oxide is added in a large amount to obtain a sufficient degree of blackness. Although the detailed reasons for giving such effects are yet unknown, it is thought that the dispersibility of the composite oxide is improved by the coexistence of the metal contained in the composite oxide and the chemical structure of the quaternary ammonium salt, wherein the metal contained in the composite oxide and the chemical structure of the quaternary ammonium salt affect each other, so that the resulting toner can have an appropriate surface resistivity, whereby the toner has excellent triboelectric properties and fixing ability.

In the present invention, the composite oxide is constituted by at least 2 metals, from the viewpoints of the degree of blackness of the toner. It is more preferable that at least one, preferably at least two, of the metals of the composite oxide belongs to the Third Period of the Periodic Table, or to Groups 2 to 12 of the Fourth Period of the Periodic Table. Specifically, magnesium (Mg), aluminum (Al), scandium (Sc), titanium (Ti), vanadium (V), chromium (Cr), manganese (Mn), iron (Fe), cobalt (Co), nickel (Ni) and copper (Cu). Especially, Mg, Al, Ti, Mn, Fe and Cu are preferable, and Mg, Al, Ti, Fe and Cu are especially preferable. The compositional ratio of the metals in the composite oxide is not particularly limited.

The composite oxide has an average particle size of preferably from 2 nm to 1 μm, more preferably from 5 to 450 nm, especially preferably from 5 to 200 nm, from the viewpoints of the covering strength and the dispersibility in the resin.

The content of the composite oxide is preferably from 1 to 40 parts by weight, more preferably from 2.5 to 30 parts by weight, especially preferably from 4 to 25 parts by weight, based on 100 parts by weight of the resin binder, from the viewpoints of the degree of blackness and the triboelectric chargeability of the toner.

The process for preparing a composite oxide includes a process comprising depositing other oxide on a surface of the main oxide used as a core particle (Japanese Patent Laid-Open No. 2000-10344 (U.S. Pat. No. 6,130,017)), a process of making a composite oxide comprising sintering several oxides (Japanese Patent Laid-Open No. Hei 9-25126), and the like, without being particularly limited thereto.

The preferable commercially available composite oxide in the present invention includes "Dye Pyroxide Black No. 1," "Dye Pyroxide Black No. 2" (hereinabove commercially available from DAINICHISEIKA COLOR & CHEMICALS MFG. CO., LTD.), "HSB-605" (commercially available from Toda Kogyo Corp.), "ETB-100" (commercially available from Titan Kogyo K. K.), MC Series such as "MC-3,"

"MC-6," "MC-7," "MC-8" and "MC-10" (commercially available from MITSUI MINING & SMELTING CO., LTD.), "K-002" (commercially available from Toda Kogyo Corp.), and the like.

The toner of the present invention may contain a known colorant other than the above-mentioned composite oxide as a colorant, but it is preferable that carbon black is not contained.

It is preferable that the quaternary ammonium salt is a compound represented by the formula (I):

(I)

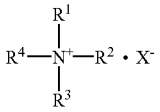

wherein each of $R^1$ to $R^4$, which may be identical or different, is a lower alkyl group having 1 to 8 carbon atoms which may be substituted by a halogen atom, an alkyl group or alkenyl group having 8 to 22 carbon atoms, or an aryl group or aralkyl group having 6 to 20 carbon atoms; and $X^-$ is an anion.

In the present invention, from the viewpoints of giving a toner with more stable triboelectric chargeability and more improved fixing ability, it is preferable that each of $R^1$ to $R^4$ is a lower alkyl group having 1 to 4 carbon atoms which may be substituted by a halogen atom, an alkyl group having 12 to 18 carbon atoms, phenyl group or benzyl group, and that $X^-$ is an aromatic sulfonate ion such as toluenesulfonate ion or hydroxynaphthalenesulfonate ion; an aromatic carboxylate ion; molybdate ion; tungstate ion; a halogen ion or hydroxide ion, more preferably the aromatic sulfonate ion, the aromatic carboxylate ion and the molybdate ion.

In the present invention, the compound represented by the formula (I) is especially preferably at least one compound selected from the group consisting of a compound represented by the formula (Ia):

(Ia)

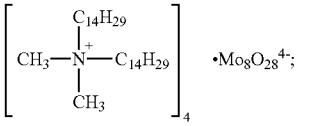

a compound represented by the formula (Ib):

(Ib)

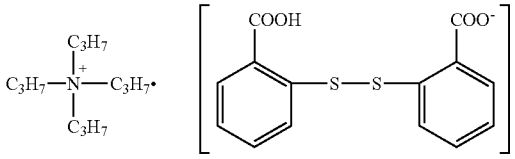

;and a compound represented by the formula (Ic):

(Ic)

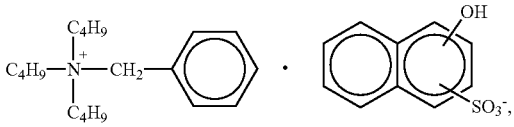

the compound represented by the formula (Ib) is more preferable.

The commercially available product containing the compound represented by the formula (Ia) includes "TP-415" (commercially available from Hodogaya Chemical Co., Ltd.), and the like. The commercially available product containing the compound represented by the formula (Ib) includes "COPY CHARGE PSY" (commercially available from Clariant (Japan) K.K.), and the like. The commercially available product containing the compound represented by the formula (Ic) includes "BONTRON P-51" (commercially available from Orient Chemical Co., Ltd.), and the like.

The content of the quaternary ammonium salt is preferably from 0.01 to 5 parts by weight, more preferably from 0.05 to 3 parts by weight, especially preferably from 0.1 to 2 parts by weight, based on 100 parts by weight of the resin binder.

In the present invention, it is preferable that a positively chargeable toner comprises a nigrosine dye together with the quaternary ammonium salt, and that a negatively chargeable toner comprises a metal-containing azo dye and/or a metal complex of an aromatic hydroxycarboxylic acid together with the quaternary ammonium salt.

Each of the nigrosine dye serving as a positively chargeable charge control agent and the metal-containing azo dye serving as a negatively chargeable charge control agent has high triboelectric chargeability, and has black color, so that it supplements the degree of blackness of the composite oxide. Further, by the combined use with the quaternary ammonium salt, the charge control agents contribute to adjustment of positive or negative triboelectric chargeability and triboelectric stability of the toner.

The nigrosine dye is a black mixture of multi-components generally obtained by polycondensation of nitrobenzene with aniline in the presence of a metal catalyst. Although its structure has not been sufficiently elucidated, the commercially available nigrosine dyes, including the products modified by a resin acid, include "Nigrosine Base EX," "Oil Black BS," "Oil Black SO," "BONTRON N-01," "BONTRON N-04," "BONTRON N-07," "BONTRON N-09," "BONTRON N-11," "BONTRON N-21" (hereinabove commercially available from Orient Chemical Co., Ltd.); "Nigrosine" (commercially available from Ikeda Kagaku Kogyo); "Spirit Black No. 850," "Spirit Black No. 900" (hereinabove commercially available from Sumitomo Chemical Company Limited); and the like. When the nigrosine dye is used together with the resin binder comprising a polyester, it is preferable to use a nigrosine dye modified by a resin acid, from the viewpoint of the dispersibility. The commercially available product of the modified nigrosine dye includes "BONTRON N-04," "BONTRON N-21" (hereinabove commercially available from Orient Chemical Co., Ltd.), and the like.

The content of the nigrosine dye is preferably from 0.2 to 5 parts by weight, more preferably from 0.5 to 4 parts by weight, based on 100 parts by weight of the resin binder. In addition, the weight ratio of the quaternary ammonium salt to the nigrosine dye is preferably from 1/100 to 100/100, more preferably from 10/100 to 70/100.

The meta-containing azo dye is a compound obtained by a coupling reaction of an aminophenol derivative with a naphthol derivative. It is preferable that the metal-containing azo dye is a compound represented by the formula (II):

(II)

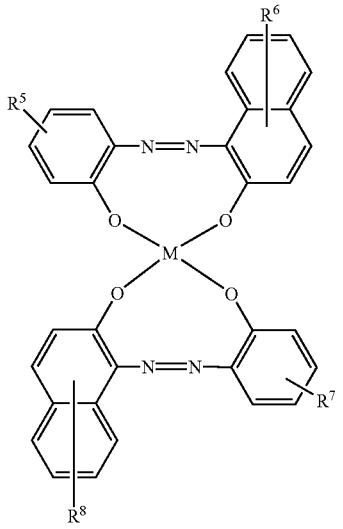

wherein each of $R^5$ and $R^7$, which is identical, is a halogen atom or nitro group; each of $R^6$ and $R^8$, which is identical, is hydrogen atom, an alkyl group having 1 to 3 carbon atoms or a halogen atom, and $R^6$ and $R^8$ are preferably identical halogen atoms; and M is chromium atom or iron atom.

The commercially available metal-containing azo dye includes "BONTRON S-32," "BONTRON S-33," "BONTRON S-34," "BONTRON S-35," "BONTRON S-37," "BONTRON S-38," "BONTRON S-40," "BONTRON S-44" (hereinabove commercially available from Orient Chemical Co., Ltd.); "T-95," "AIZEN SPILON BLACK TRH" (commercially available from Hodogaya Chemical Co., Ltd.), and the like.

The content of the metal-containing azo dye is preferably from 0.1 to 5 parts by weight, more preferably from 0.3 to 3 parts by weight, based on 100 parts by weight of the resin binder. In addition, the weight ratio of the quaternary ammonium salt to the metal-containing azo dye is preferably from 1/100 to 100/100, more preferably from 10/100 to 70/100.

The metal complex of an aromatic hydroxycarboxylic acid can serve to further improve the triboelectric chargeability as a negatively chargeable charge control agent, especially in a case where the initial rise in the triboelectric charges is required, for instance, in the nonmagnetic one-component development.

It is preferable that the metal complex of an aromatic hydroxycarboxylic acid is a compound represented by the formula (III):

(III)

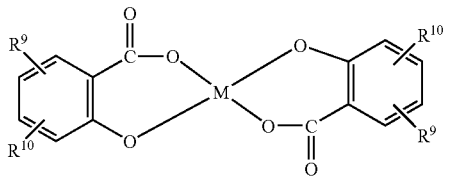

wherein each of $R^9$ and $R^{10}$, which may be identical or different, is an alkyl group having 1 to 8 carbon atoms, preferably tert-butyl group; and M is chromium atom, iron atom or zinc atom.

The commercially available metal complex of an aromatic hydroxycarboxylic acid includes "BONTRON E-81," "BONTRON E-84" (hereinabove commercially available from Orient Chemical Co., Ltd.); and the like.

The content of the metal complex of an aromatic hydroxycarboxylic acid is preferably from 0.1 to 10 parts by weight, more preferably from 0.5 to 5 parts by weight, based on 100 parts by weight of the resin binder. In addition, the weight ratio of the quaternary ammonium salt to the metal complex of an aromatic hydroxycarboxylic acid is preferably from 1/100 to 100/100, more preferably from 10/100 to 70/100.

The resin binder in the present invention includes polyesters, mixed resins of polyester/styrene-acrylic resins; hybrid resins, styrene-acrylic resins, and the like. Among them, from the viewpoints of the low-temperature fixing ability, the durability and the dispersibility of the additive, those resin binders comprising a polyester as a major component are preferable. The content of the polyester is preferably from 50 to 100% by weight, more preferably from 70 to 100% by weight, of the resin binder.

The term "hybrid resin" as referred to herein is a resin in which a condensation polymerization resin component, such as a polyester, a polyester-polyamide or a polyamide, is partially chemically bonded with an addition polymerization resin component such as a vinyl resin. The hybrid resin may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable.

The raw material monomers for the polyester are not particularly limited, and include known alcoholic components and known carboxylic acid components such as carboxylic acids, carboxylic acid anhydrides and carboxylic acid esters.

It is preferable that the alcoholic component contains a compound represented by the formula (IV):

(IV)

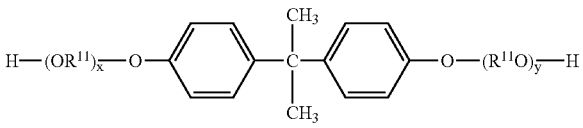

wherein $R^{11}$ is an alkylene group having 2 or 3 carbon atoms; x and y are a positive number; and the sum of x and y is from 1 to 16, preferably from 1.5 to 5.0.

The compound represented by the formula (IV) includes alkylene(2 or 3 carbon atoms) oxide(average number of moles added: 1 to 16 moles) adducts of bisphenol A such as polyoxypropylene(2.2)-2,2-bis(4-hydroxyphenyl)propane and polyoxyethylene(2.2)-2,2-bis(4-hydroxyphenyl)propane, and the like. In addition, other alcoholic components include ethylene glycol, propylene glycol, glycerol, pentaerythritol, trimethylolpropane, hydrogenated bisphenol A, sorbitol, alkylene(2 to 4 carbon atoms) oxide(average number of moles added: 1 to 16 moles) adducts thereof, and the like, and it is preferable that these compounds can be contained in the alcoholic component alone or in admixture of two or more kinds.

It is desired that the content of the compound represented by the formula (IV) is 5% by mol or more, preferably 50% by mol or more, more preferably 100% by mol, of the alcoholic component.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid and octenylsuccinic acid; tricarboxylic or higher polycarboxylic acids such as trimellitic acid and pyromellitic acid; acid anhydrides thereof; alkyl(1 to 8 carbon atoms) esters thereof; and the like. It is preferable that these carboxylic acid components can be used alone or in admixture of two or more kinds.

The polyester can be prepared by, for instance, polycondensation of an alcoholic component with a carboxylic acid component or the like at a temperature of 180° to 250° C. in an inert gas atmosphere using an esterification catalyst as desired.

When the toner of the present invention is used as a positively chargeable toner, the polyester has an acid value of preferably from 0.5 to 15 mg KOH/g, more preferably from 1 to 12 mg KOH/g, especially preferably from 1.5 to 10 mg KOH/g.

Alternatively, When the toner of the present invention is used as a negatively chargeable toner, the polyester has an acid value of preferably from 5 to 40 mg KOH/g, more preferably from 10 to 35 mg KOH/g, especially preferably from 15 to 30 mg KOH/g.

In addition, the polyester has a softening point of preferably from 80° to 165° C., and a glass transition point of preferably from 50° to 85° C.

Further, in the present invention, it is preferable that the toner of the present invention further comprises at least one low-melting point wax selected from the group consisting of carnauba wax, montanic acid ester-based wax, rice wax and candelilla wax, from the viewpoints of the low-temperature fixing ability and the prevention of toner spent. When the composite oxide used as a black colorant is added in a large amount for the purpose of increasing the degree of blackness, there may arise fixing failure. However, by the inclusion of the low-melting point wax, the fixing ability can be improved. Especially when the carnauba wax is used as a releasing agent and the polyester is used as a resin binder, the compatibility improves, so that the carnauba wax is uniformly dispersed in the resin binder, which in turn improves the fixing ability of the resulting toner.

The low-melting point wax has a melting point of preferably from 40° to 120° C., more preferably from 60° to 100° C., especially preferably from 70° to 90° C.

The content of the low-melting point wax is preferably from 0.1 to 8 parts by weight, more preferably from 0.5 to 5 parts by weight, especially preferably from 1 to 3 parts by weight, based on 100 parts by weight of the resin binder, from the viewpoints of the triboelectric chargeability, the fixing ability and the durability.

Furthermore, the toner of the present invention may appropriately contain an additive such as a fluidity improver, an electric conductivity modifier, an extender, a reinforcing filler such as a fibrous substance, an antioxidant, an anti-aging agent, and a cleanability improver.

The toner of the present invention can be prepared by any of conventionally known methods such as kneading and pulverization method, polymerization method, emulsion and phase inversion method. For instance, in a case of a pulverized toner prepared by kneading and pulverization method, for instance, the method comprises homogeneously mixing a resin binder, a colorant, and the like in a mixer such as a Henschel mixer or a ball-mill, thereafter melt-kneading with a closed kneader or a single-screw or twin-screw extruder, cooling, pulverizing and classifying the product. The volume-average particle size of the toner is preferably from 3 to 15 μm. Further, a fluidity improver such as hydrophobic silica or the like may be added to the surface of the toner as an external additive as occasion demands.

The toner of the present invention can be used for any developments without particular limitations. For instance, when the toner contains a particulate magnetic material, the toner can be used alone as a developer. On the other hand, when the toner does not contain any particulate magnetic material, the toner can be used as a nonmagnetic monocomponent developer, or can be mixed with a carrier to give a two-component developer.

The core material for the carrier includes an iron powder, magnetite, ferrite, and the like. Among them, in order to obtain excellent image properties, ferrite having lowered saturation magnetization is more preferable, so that the contact with the magnetic brush becomes softer.

It is preferable that the core material has a saturation magnetization of 100 $Am^2/kg$ or less, from the viewpoints of toning and reproducibility of intermediate toning, and that the core material has a saturation magnetization of 40 $Am^{2/}kg$ or less, from the viewpoints of the carrier adhesion and toner scattering.

In order to further reduce a carrier contamination, it is preferable that the surface of the core material of the carrier is coated with a fluororesin or a silicone coating for a positively chargeable toner, and that the carrier is coated with a silicone resin for a negatively chargeable toner.

The carrier has a volume-average particle size of preferably from 50 to 200 μm. The weight ratio of the toner to the carrier (toner/carrier) in a two-component developer is preferably from 0.5/100 to 8/100.

Since the toner of the present invention exhibits excellent triboelectric chargeability without deteriorating its fixing ability, the toner can be suitably used for high-speed machine for a two-component development having a linear speed of 370 cm/sec or more, preferably 500 mm/sec or more.

The toner of the present invention has a high degree of blackness, little toner scattering and excellent reproducibility for fine half-tones. Therefore, the toner of the present invention can be suitably used not only for charged area development but also for non-charged area development (reversal development).

Further, since the toner of the present invention has a resistance similar to that of colorants such as yellow, cyan and magenta, the toner is suitably used in the formation of full-color fixed images.

Furthermore, there is provided a process for developing a toner, comprising applying the toner of the present invention to a two-component developing high-speed machine having a linear speed of 370 mm/sec or more. Also, there is provided a process for developing a toner, comprising applying the toner of the present invention to a developing device for reversal development.

EXAMPLES

[Softening Point]

The softening point is determined by a method according to ASTM D36-86.

[Glass Transition Point and Melting Point]

The glass transition point and the melting point are determined using a differential scanning calorimeter (commercially available from Seiko Instruments, Inc., DSC Model 210) with raising the temperature at a rate of 10° C./min.

[Acid Value and Hydroxyl Value]

The acid value and the hydroxyl value are determined by a method according to JIS K 0070.

Preparation Example 1 of Resin

Seven-hundred and thirty five grams of polyoxypropylene (2.2)-2,2-bis(4-hydroxyphenyl)propane, 293 g of polyoxyethylene(2.2)-2,2-bis(4-hydroxyphenyl)propane, 280 g of isophtbalic acid, 60 g of isooctenylsuccinic acid, 72 g of 1,2,4-benzenetricarboxylic acid and 2 g of dibutyltin oxide were reacted at 230° C. under reduced pressure in a nitrogen gas stream atmosphere. The polymerization degree was monitored by the softening point, and the reaction was terminated when the softening point reached 136° C. The resulting resin A was a pale yellow solid having a glass transition point of 63° C., an acid value of 3.1 mg KOH/g and a hydroxyl value of 35.2 mg KOH/g.

Preparation Example 2 of Resin

A mixture of 800 g of styrene, 300 g of n-butyl acrylate, and 26 g of dicumyl peroxide was added dropwise to 550 g of xylene under a nitrogen gas atmosphere at 135° C. over 1 hour, and the mixture was further matured for 2 hours. Thereafter, xylene was removed under reduced pressure, to give a resin B. The resin B was a white solid having a softening point of 138° C. and a glass transition point of 65° C.

Preparation Example 3 of Resin

Six-hundred and thirteen grams of polyoxypropylene (2.2)-2,2-bis(4-hydroxyphenyl)propane, 244 g of polyoxyethylene(2.2)-2,2-bis(4-hydroxyphenyl)propane, 164 g of terephthalic acid, 177 g of isododecenylsuccinic anhydride, 106 g of 1,2,4-benzenetricarboxylic acid and 3 g of dibutyltin oxide were reacted at 230° C. under reduced pressure under a nitrogen gas stream. The polymerization degree was monitored by the softening point, and the reaction was terminated when the softening point reached 115° C. The resulting resin C was a pale yellow solid having a glass transition point of 61° C., an acid value of 25.3 mg KOH/g and a hydroxyl value of 30.1 mg KOH/g.

Preparation Example 4 of Resin

Eight-hundred and seventy-five grams of polyoxypropylene(2.2)-2,2-bis(4-hydroxyphenyl)propane, 295 g of fumaric acid and 0.5 g of hydroquinone (polymerization inhibitor) were reacted at 200° C. under reduced pressure under a nitrogen gas stream until the acid value reached 20 mg KOH/g, to give a resin D. The resin D had a softening point of 101° C., a glass transition point of 65° C., an acid value of 20.1 mg KOH/g and a hydroxyl value of 25.0 mg KOH/g.

Preparation Example 5 of Resin

Nine-hundred grams of polyoxypropylene(2.2)-2,2-bis(4-hydroxyphenyl)propane, 250 g of neopentyl glycol, 580 g of terephthalic acid, 130 g of trimellitic anhydride and 2 g of dibutyltin oxide were heated to 180° to 230° C. over 8 hours, and thereafter reacted under reduced pressure under a nitrogen gas stream. The polymerization degree was monitored by the acid value, and the reaction was terminated when the acid value reached 10.2 mg KOH/g. The resulting resin E was a pale yellow solid having a softening point of 145° C., a glass transition point of 66° C., an acid value of 10.2 mg KOH/g and a hydroxyl value of 45.2 mg KOH/g.

Examples A1 to A9 and Comparative Examples A1 to A3 (Positively Chargeable Toner for Two-component Development)

The raw materials as shown in Table 1 were pre-mixed with a Henschel Mixer, and thereafter the mixture was melt-kneaded with a twin-screw kneader, and cooled. Subsequently, the resulting product was subjected to usual pulverization and classification steps, to give a powder. To 100 parts by weight of the resulting powder, 0.3 parts by weight of a hydrophobic silica "HVK 2150" (commercially available from Clariant (Japan) K.K.) were mixed and adhered with a Henschel Mixer, to give a toner having a volume-average particle size of 10 μm.

TABLE 1

| | Resin | Black Colorant | Quaternary Ammonium Salt | Nigrosine Dye | Wax |
|---|---|---|---|---|---|
| Example A1 | A (100) | MC-7 (20) | PSY (0.5) | — | NP-055 (1) |
| Example A2 | A (100) | MC-7 (20) | P-51 (1) | — | NP-055 (1) |
| Example A3 | A (100) | MC-7 (20) | TP-415 (1) | — | NP-055 (1) |
| Example A4 | B (100) | MC-7 (20) | PSY (0.5) | — | NP-055 (1) |

TABLE 1-continued

| | Resin | Black Colorant | Quaternary Ammonium Salt | Nigrosine Dye | Wax |
|---|---|---|---|---|---|
| Example A5 | E (100) | MC-7 (20) | PSY (0.5) | — | NP-055 (1) |
| Example A6 | A (100) | MC-7 (20) | PSY (0.5) | N-04 (1) | NP-055 (1) |
| Example A7 | A (100) | MC-7 (18) | PSY (0.5) | N-21 (1) | Carnauba Wax No. 1 (1) |
| Example A8 | A (100) | MC-10 (20) | PSY (0.5) | N-04 (1) | Carnauba Wax No. 1 (1) |
| Example A9 | A (100) | K-002 (20) | PSY (0.5) | N-04 (1) | Carnauba Wax No. 1 (1) |
| Comparative Example A1 | A (100) | MC-7 (20) | — | N-01 (1) | NP-055 (1) |
| Comparative Example A2 | A (100) | R 330R (7) | PSY (0.5) | — | NP-055 (1) |
| Comparative Example A3 | A (100) | R 330R (7) | — | N-01 (1) | NP-055 (1) |

Here, each of the raw materials shown in Tables including those shown below is as follows, and each of the number in parentheses represents used amount (parts by weight).

MC-6: commercially available from MITSUI MINING & SMELTING CO., LTD., major metals contained: Fe, Mn, Cu MC-7: commercially available from MITSUI MINING & SMELTING CO., LTD., major metals contained: Fe, Mn MC-10: commercially available from MITSUI MINING & SMELTING CO., LTD., major metals contained: Mg, Al, Fe K-002: commercially available from Toda Kogyo Corp., major metals contained: Fe, Ti R330R: commercially available from Cabot Corporation, carbon black P-51: BONTRON P-51, commercially available from Orient Chemical Co., Ltd.

PSY: COPY CHARGE PSY, commercially available from Clariant (Japan) K.K.

TP-415: commercially available from Hodogaya Chemical Co., Ltd.

N-01: BONTRON N-01, commercially available from Orient Chemical Co., Ltd.

N-04: BONTRON N-04, commercially available from Orient Chemical Co., Ltd.

N-21: BONTRON N-21, commercially available from Orient Chemical Co., Ltd.

S-34: BONTRON S-34, commercially available from Orient Chemical Co., Ltd.

TRH: AIZEN SPILON BLACK TRH, commercially available from Hodogaya Chemical Co., Ltd.

E-81: BONTRON E-81, commercially available from Orient Chemical Co., Ltd.

E-84: BONTRON E-84, commercially available from Orient Chemical Co., Ltd.

NP-055: commercially available from MITSUI CHEMICALS, INC., polypropylene wax, melting point: 142° C.

Carnauba Wax No. 1: commercially available from K. K. Kato Yoko, melting point: 83° C.

Test Example 1

Using each of the toners of Examples A1 to A9 and Comparative Examples A1 to A3, 39 parts by weight of the toner and 1261 parts by weight of a fluororesin/acrylic resin-coated ferrite carrier having a saturation magnetization of 60 $Am^2/kg$ (average particles size: 110 μm) were mixed with a Nauta Mixer, to give each two-component developer.

A developer was loaded in a two-component development device for contact development "Infoprint 4000 ID3, ID4" (commercially available from IBM Japan, Ltd., linear speed: 1509 mm/sec, resolution: 240 dpi, development system: 3 magnet rollers and selenium photoconductor, reversal development, DUPLEX SYSTEM). A 50000-sheet, a 100000-sheet, a 250000-sheet and a 500000-sheet continuous printings with a printing pattern having 20% blackened ratio were carried out using a continuous feeding paper with 11×18 inches. Thereafter, the triboelectric charges, the solid image quality, the toner scattering and the toner drop were evaluated by the methods described below. Incidentally, the toner used for replenishment during the continuous printing was the same kind of toner. The results are shown in Table 2.

[Triboelectric Charges]

Measuring apparatus: q/m-meter commercially available from Epping GmbH

Settings: Mesh size: 400 mesh (made of stainless steel)

Soft blow

Blow pressure (1050 V)

Aspiration time: 90 seconds $$\text{Triboelectric Charges } (\mu C/g) = \frac{\text{Total Electric Charges After 90 Seconds } (\mu C)}{\text{Amount of Toner Aspirated } (g)}$$

[Solid Image Quality]

The image density (blackened degree) and the evenness of the solid image bearing pattern of a printed pattern are visually evaluated as follows.

Evaluation Criteria

| |
|---|
| ⊚: Excellent |
| ○: Good |
| Δ: Allowable level for practical use |
| X: Impractical |

[Toner Scattering]

The extent of toner scattering within the device is visually evaluated as follows.

Evaluation Criteria

| |
|---|
| ⊙: Excellent |
| ○: Good |
| Δ: Allowable level for practical use |
| X: Impractical |

[Toner Drop]

After each continuous printing, additional 1000-sheet printing is carried out, and the number of sheets in which toner drop, that is, toner dropped in a lump on a non-image bearing portion, is confirmed is counted. The toner drop is evaluated as follows.

Evaluation Criteria

| | |
|---|---|
| ⊙: | Excellent (No toner drop is confirmed.) |
| ○: | Good (Toner drop is generated in 1 or 2 sheets.) |
| Δ: | Allowable level for practical use (Toner drop is generated in 3 or 4 sheets.) |
| X: | Impractical (Toner drop is generated in 5 or more sheets.) |

TABLE 2

| | 50000 Sheets | 100000 Sheets | 250000 Sheets | 500000 Sheets |
|---|---|---|---|---|
| Example A1 | | | | |
| Triboelectric Charges | 19.5 | 20.8 | 19.1 | 18.4 |
| Solid Image Quality | ⊙ | ⊙ | ⊙ | ○ |
| Toner Scattering | ⊙ | ⊙ | ○ | ○ |
| Toner Drop | ⊙ | ○ | ○ | ○ |
| Example A2 | | | | |
| Triboelectric Charges | 19.3 | 19.9 | 18.8 | 18.6 |
| Solid Image Quality | ⊙ | ⊙ | ○ | ○ |
| Toner Scattering | ○ | ○ | ○ | ○ |
| Toner Drop | ⊙ | ○ | ○ | ○ |
| Example A3 | | | | |
| Triboelectric Charges | 18.3 | 19.7 | 17.8 | 18.6 |
| Solid Image Quality | ⊙ | ⊙ | ○ | ○ |
| Toner Scattering | ○ | ○ | ○ | ○ |
| Toner Drop | ⊙ | ○ | ○ | Δ |
| Example A4 | | | | |
| Triboelectric Charges | 21.2 | 19.8 | 18.3 | 16.9 |
| Solid Image Quality | ○ | ○ | Δ | Δ |
| Toner Scattering | ○ | ○ | ○ | Δ |
| Toner Drop | ○ | ○ | Δ | Δ |
| Example A5 | | | | |
| Triboelectric Charges | 19.8 | 21.2 | 20.3 | 19.1 |
| Solid Image Quality | ⊙ | ○ | ○ | Δ |
| Toner Scattering | ○ | ○ | ○ | ○ |
| Toner Drop | ⊙ | ○ | ○ | ○ |
| Example A6 | | | | |
| Triboelectric Charges | 20.4 | 19.6 | 20.1 | 21.7 |
| Solid Image Quality | ⊙ | ⊙ | ○ | ○ |

TABLE 2-continued

| | 50000 Sheets | 100000 Sheets | 250000 Sheets | 500000 Sheets |
|---|---|---|---|---|
| Toner Scattering | ⊙ | ⊙ | ⊙ | ○ |
| Toner Drop | ⊙ | ⊙ | ○ | ○ |
| Example A7 | | | | |
| Triboelectric Charges | 20.8 | 21.1 | 20.9 | 21.3 |
| Solid Image Quality | ⊙ | ⊙ | ⊙ | ⊙ |
| Toner Scattering | ⊙ | ⊙ | ⊙ | ⊙ |
| Toner Drop | ⊙ | ⊙ | ⊙ | ⊙ |
| Example A8 | | | | |
| Triboelectric Charges | 20.9 | 21.3 | 21.2 | 21.0 |
| Solid Image Quality | ⊙ | ⊙ | ⊙ | ⊙ |
| Toner Scattering | ⊙ | ⊙ | ⊙ | ⊙ |
| Toner Drop | ⊙ | ⊙ | ⊙ | ⊙ |
| Example A8 | | | | |
| Triboelectric Charges | 20.9 | 21.3 | 21.2 | 21.0 |
| Solid Image Quality | ⊙ | ⊙ | ⊙ | ⊙ |
| Toner Scattering | ⊙ | ⊙ | ⊙ | ⊙ |
| Toner Drop | ⊙ | ⊙ | ⊙ | ⊙ |
| Example A9 | | | | |
| Triboelectric Charges | 21.1 | 20.9 | 21.3 | 21.4 |
| Solid Image Quality | ⊙ | ⊙ | ⊙ | ⊙ |
| Toner Scattering | ⊙ | ⊙ | ⊙ | ⊙ |
| Toner Drop | ⊙ | ⊙ | ⊙ | ⊙ |
| Comparative Example A1 | | | | |
| Triboelectric Charges | 23.1 | 24.6 | 26.5 | 28.7 |
| Solid Image Quality | Δ | Δ | X | X |
| Toner Scattering | ○ | ○ | ○ | Δ |
| Toner Drop | ○ | ○ | ○ | X |
| Comparative Example A2 | | | | |
| Triboelectric Charges | 18.3 | 16.9 | 15.3 | 13.7 |
| Solid Image Quality | ○ | Δ | X | X |
| Toner Scattering | ○ | Δ | Δ | X |
| Toner Drop | ○ | Δ | X | X |
| Comparative Example A3 | | | | |
| Triboelectric Charges | 17.8 | 19.1 | 17.3 | 16.4 |
| Solid Image Quality | ○ | Δ | X | X |
| Toner Scattering | ○ | Δ | Δ | X |
| Toner Drop | Δ | Δ | X | X |

Examples B1 to B4 and Comparative Examples B1 and B2 (Positively Chargeable Toner for Nonmagnetic Monocomponent Development)

The same procedures were carried out as in Example 1 except that the raw materials as shown in Table 3 were used, and that 1.0 part by weight of "RA 200H" (commercially available from Nippon Aerosil) was used in place of "HVK 2150" as a hydrophobic silica, to give a toner.

TABLE 3

| | Resin | Black Colorant | Quaternary Ammonium Salt | Nigrosine Dye | Wax |
|---|---|---|---|---|---|
| Example B1 | A (100) | MC-7 (20) | PSY (0.5) | — | NP-055 (1) |
| Example B2 | A (100) | MC-7 (20) | P-51 (1) | — | NP-055 (1) |
| Example B3 | A (100) | MC-7 (20) | PSY (0.5) | N-21 (1) | NP-055 (1) |
| Example B4 | A (100) | MC-7 (18) | PSY (0.5) | N-21 (1) | Carnauba Wax No. 1 (1) |
| Comparative Example B1 | A (100) | MC-7 (20) | — | N-01 (1) | NP-055 (1) |
| Comparative Example B2 | A (100) | R 330R (7) | PSY (0.5) | — | NP-055 (1) |

Test Example 2

Each of the toners of Examples B1 to B4 and Comparative Examples B1 and B2 was loaded in a nonmagnetic monocomponent development device for contact development "HL-1040" (commercially available from BROTHER INDUSTRIES, LTD., linear speed: 100 mm/sec, resolution: 600 dpi, development system: organic photoconductor, reversal development). A 3000-sheet, a 6000-sheet and a 10000-sheet continuous printings with a printed pattern having 5% blackened ratio were carried out using legal-sized sheets. Thereafter, the solid image quality was evaluated as in Test Example 1, the triboelectric charges, the solid image reproducibility and the background fogging were evaluated by the methods described below. The results are shown in Table 4.

[Triboelectric Charges]

Measuring apparatus: Aspiration-type small-sized triboelectric charges measuring apparatus commercially available from TRECK JAPAN

| | |
|---|---|
| Settings: | Mesh size: Grade 1 (diameter: 2.5 cm) commercially available from Whatman International Ltd.<br>Aspiration time: The toner on the development roller is aspirated until the voltage of the indicator unit is constant. |

$$\text{Triboelectric Charges } (\mu C/g) = \frac{\text{Total Electric Charges After Aspirating Toner } (\mu C)}{\text{Amount of Toner Aspirated (g)}}$$

[Solid Image Reproducibility]

Blur in the solid image-bearing portion of the printed pattern is visually evaluated as follows.

Evaluation Criteria

| | |
|---|---|
| ◎: Excellent | |
| ○: Good | |
| Δ: Allowable level for practical use | |
| X: Impractical | |

[Background Fogging]

The extent of toner adhesion to a non-image bearing portion of the printed pattern is visually evaluated as follows.

Evaluation Criteria

| | |
|---|---|
| ◎: Excellent | |
| ○: Good | |
| Δ: Allowable level for practical use | |
| X: Impractical | |

TABLE 4

| | 0 Sheet | 3000 Sheets | 6000 Sheets | 10000 Sheets |
|---|---|---|---|---|
| Example B1 | | | | |
| Triboelectric Charges | 26.1 | 26.8 | 26.5 | 25.9 |
| Solid Image Quality | ◎ | ○ | ○ | ○ |
| Solid Image Reproducibility | ◎ | ◎ | ○ | ○ |
| Background Fogging | ◎ | ○ | ○ | ○ |
| Example B2 | | | | |
| Triboelectric Charges | 26.7 | 24.2 | 23.8 | 24.5 |
| Solid Image Quality | ◎ | ○ | ○ | ○ |
| Solid Image Reproducibility | ○ | ○ | ○ | Δ |
| Background Fogging | ◎ | ○ | ○ | ○ |
| Example B3 | | | | |
| Triboelectric Charges | 26.6 | 27.0 | 27.4 | 27.5 |
| Solid Image Quality | ◎ | ◎ | ○ | ○ |
| Solid Image Reproducibility | ◎ | ◎ | ◎ | ○ |
| Background Fogging | ◎ | ◎ | ○ | ○ |
| Example B4 | | | | |
| Triboelectric Charges | 27.3 | 27.6 | 27.2 | 27.4 |
| Solid Image Quality | ◎ | ◎ | ◎ | ◎ |
| Solid Image Reproducibility | ◎ | ◎ | ◎ | ◎ |
| Background Fogging | ◎ | ◎ | ◎ | ◎ |
| Comparative Example B1 | | | | |
| Triboelectric Charges | 28.6 | 33.3 | 35.7 | 39.1 |
| Solid Image Quality | ○ | Δ | X | X |
| Solid Image Reproducibility | ○ | ○ | Δ | Δ |
| Background Fogging | ○ | Δ | ○ | X |
| Comparative Example B2 | | | | |
| Triboelectric Charges | 24.2 | 20.7 | 16.8 | 12.6 |
| Solid Image Quality | ○ | Δ | X | X |
| Solid Image Reproducibility | ○ | Δ | X | X |
| Background Fogging | ○ | ○ | Δ | X |

Examples C1 to C6 and Comparative Examples C1 and C2 (Negatively Chargeable Toner for Two-component Development)

The same procedures were carried out as in Example 1 except that the raw materials as shown in Table 5 were used, and that 0.3 parts by weight of "TS-530" (commercially available from Cabot Corporation) were used in place of "HVK 2150" as a hydrophobic silica, to give a toner.

TABLE 5

| | Resin | Black Colorant | Quaternary Ammonium Salt | Azo Dye | Wax |
|---|---|---|---|---|---|
| Example C1 | C (100) | MC-6 (20) | PSY (0.2) | TRH (1) | NP-055 (1) |
| Example C2 | C (100) | MC-6 (20) | P-51 (0.2) | TRH (1) | NP-055 (1) |
| Example C3 | C (100) | MC-6 (20) | PSY (0.2) | S-34 (1) | NP-055 (1) |
| Example C4 | C (100) | MC-6 (18) | PSY (0.2) | S-34 (1) | Carnauba Wax No. 1 (1) |
| Example C5 | C (100) | MC-10 (20) | PSY (0.2) | S-34 (1) | Carnauba Wax No. 1 (1) |
| Example C6 | C (100) | K-002 (20) | PSY (0.2) | S-34 (1) | Carnauba Wax No. 1 (1) |
| Comparative Example C1 | C (100) | MC-6 (20) | — | S-34 (1) | NP-055 (1) |
| Comparative Example C2 | C (100) | R 330R (7) | PSY (0.2) | — | NP-055 (1) |

Test Example 3

Using each of the toners of Examples C1 to C6 and Comparative Examples C1 and C2, 39 parts by weight of the toner and 1261 parts by weight of a silicone resin-coated ferrite carrier having a saturation magnetization of 70 $Am^2/kg$ (average particles size: 100 μm) were mixed with a Nauta Mixer, to give each two-component developer.

A developer was loaded in a contact two-component development device "AR-505" (commercially available from Sharp Corporation, linear speed: 250 mm/sec, resolution: 600 dpi, development system: 1 magnet roller and organic photoconductor, reversal development). A 5000-sheet, a 20000-sheet, a 50000-sheet and a 100000-sheet continuous printings with a printed pattern having 5% blackened ratio were carried out using A4 size cut sheets. Thereafter, the triboelectric charges, the solid image quality, the toner scattering and the toner drop were evaluated in the same manner as in Test Example 1. Incidentally, the toner used for replenishment during the continuous printing was the same kind of toner. The results are shown in Table 6.

TABLE 6

| | 5000 Sheets | 20000 Sheets | 50000 Sheets | 100000 Sheets |
|---|---|---|---|---|
| Example C1 | | | | |
| Triboelectric Charges | −18.5 | −21.8 | −19.4 | −17.8 |
| Solid Image Quality | ◎ | ◎ | ○ | ○ |
| Toner Scattering | ○ | ○ | ○ | ○ |
| Toner Drop | ◎ | ◎ | ◎ | ○ |
| Example C2 | | | | |
| Triboelectric Charges | −18.5 | −18.9 | −20.5 | −19.6 |
| Solid Image Quality | ◎ | ◎ | ○ | ○ |
| Toner Scattering | ○ | ○ | ○ | ○ |
| Toner Drop | ◎ | ○ | ○ | ○ |
| Example C3 | | | | |
| Triboelectric Charges | −21.2 | −20.5 | −19.4 | −19.9 |
| Solid Image Quality | ◎ | ◎ | ◎ | ○ |
| Toner Scattering | ◎ | ◎ | ○ | ○ |
| Toner Drop | ◎ | ◎ | ◎ | ○ |
| Example C4 | | | | |
| Triboelectric Charges | −21.7 | −21.6 | −21.3 | −22.4 |
| Solid Image Quality | ◎ | ◎ | ◎ | ◎ |
| Toner Scattering | ◎ | ◎ | ◎ | ◎ |
| Toner Drop | ◎ | ◎ | ◎ | ◎ |
| Example C5 | | | | |
| Triboelectric Charges | −21.4 | −21.7 | −21.7 | −22.0 |

TABLE 6-continued

| | 5000 Sheets | 20000 Sheets | 50000 Sheets | 100000 Sheets |
|---|---|---|---|---|
| Solid Image Quality | ◎ | ◎ | ◎ | ◎ |
| Toner Scattering | ◎ | ◎ | ◎ | ◎ |
| Toner Drop | ◎ | ◎ | ◎ | ◎ |
| Example C6 | | | | |
| Triboelectric Charges | −20.6 | −21.1 | −21.3 | −21.2 |
| Solid Image Quality | ◎ | ◎ | ◎ | ◎ |
| Toner Scattering | ◎ | ◎ | ◎ | ◎ |
| Toner Drop | ◎ | ◎ | ◎ | ◎ |
| Comparative Example C1 | | | | |
| Triboelectric Charges | −23.4 | −28.1 | −32.8 | −34.6 |
| Solid Image Quality | Δ | Δ | X | X |
| Toner Scattering | ○ | ○ | ○ | X |
| Toner Drop | ○ | ○ | Δ | Δ |
| Comparative Example C2 | | | | |
| Triboelectric Charges | −18.9 | −16.5 | −14.2 | −11.0 |
| Solid Image Quality | ○ | Δ | Δ | X |
| Toner Scattering | Δ | X | X | X |
| Toner Drop | ○ | Δ | X | X |

Examples D1 to D4 and Comparative Examples D1 and D2 (Negatively Chargeable Toner for Nonmagnetic Monocomponent Development)

The same procedures were carried out as in Example 1 except that the raw materials as shown in Table 7 were used, and that 1.0 part by weight of "R-972" (commercially available from Nippon Aerosil) was used in place of "HVK 2150" as a hydrophobic silica, to give a toner.

TABLE 7

| | Resin | Black Colorant | Quaternary Ammonium | Complex of Metal | Wax |
|---|---|---|---|---|---|
| Example D1 | D (100) | MC-7 (20) | PSY (0.2) | E-84 (1) | NP-055 (1) |
| Example D2 | D (100) | MC-7 (20) | TP-415 (0.2) | E-84 (1) | NP-055 (1) |
| Example D3 | D (100) | MC-7 (20) | P-51 (0.5) | E-81 (1) | NP-055 (1) |
| Example D4 | D (100) | MC-7 (18) | PSY (0.2) | E-81 (1) | Carnauba Wax No. 1 (1) |
| Comparative Example D1 | D (100) | MC-7 (20) | — | E-81 (1) | NP-055 (1) |
| Comparative Example D2 | D (100) | R 330R (7) | PSY (0.2) | — | NP-055 (1) |

Test Example 4

Each of the toners of Examples D1 to D4 and Comparative Examples D1 and D2 was loaded in a contact nonmagnetic monocomponent development device "KTX-P840" (commercially available from Matsushita Electric Industrial Co., Ltd., linear speed: 97 mm/sec, resolution: 600 dpi, development system: organic photoconductor, reversal development). A 2000-sheet, a 4000-sheet, a 6000-sheet, and a 10000-sheet continuous printings with a printing pattern having 5% blackened ratio were carried out using A4 size cut sheets. Thereafter, the triboelectric charges, the solid image quality, the solid image reproducibility and the background fogging were evaluated as in Test Example 2. The results are shown in Table 8.

TABLE 8

| | 0 Sheet | 2000 Sheets | 4000 Sheets | 6000 Sheets |
|---|---|---|---|---|
| Example D1 | | | | |
| Triboelectric Charges | −27.8 | −24.3 | −23.7 | −24.2 |
| Solid Image Quality | ◎ | ◎ | ○ | ○ |
| Solid Image Reproducibility | ◎ | ○ | ○ | ○ |
| Background Fogging | ◎ | ○ | ○ | ○ |
| Example D2 | | | | |
| Triboelectric Charges | −28.6 | −25.4 | −23.7 | −22.1 |
| Solid Image Quality | ◎ | ○ | ○ | Δ |
| Solid Image Reproducibility | ○ | ○ | ○ | Δ |
| Background Fogging | ○ | ○ | ○ | ○ |
| Example D3 | | | | |
| Triboelectric Charges | −27.1 | −26.5 | −25.9 | −26.2 |
| Solid Image Quality | ◎ | ◎ | ○ | ○ |
| Solid Image Reproducibility | ◎ | ◎ | ◎ | ○ |
| Background Fogging | ◎ | ◎ | ○ | ○ |
| Example D4 | | | | |
| Triboelectric Charges | −27.7 | −28.1 | −28.4 | −28.9 |
| Solid Image Quality | ◎ | ◎ | ◎ | ◎ |
| Solid Image Reproducibility | ◎ | ◎ | ◎ | ◎ |
| Background Fogging | ◎ | ◎ | ◎ | ◎ |
| Comparative Example D1 | | | | |
| Triboelectric Charges | −29.8 | −32.4 | −35.7 | −38.2 |
| Solid Image Quality | ○ | Δ | X | X |
| Solid Image Reproducibility | ○ | ○ | Δ | X |
| Background Fogging | ○ | ○ | Δ | Δ |
| Comparative Example D2 | | | | |
| Triboelectric Charges | −21.6 | −18.7 | −14.2 | −12.9 |
| Solid Image Quality | Δ | Δ | Δ | X |
| Solid Image Reproducibility | Δ | X | X | X |
| Background Fogging | ○ | Δ | X | X |

As is seen from the above results, the toners of Examples are excellent in stability and the initial rise in the triboelectric charges, and in both two-component development and nonmagnetic monocomponent development, thereby continuously giving excellent fixed images. On the other hand, the toners of Comparative Examples in which a composite oxide is used as a colorant but a quaternary ammonium salt is not used have unstable and very high level of triboelectric charges. The toners of Comparative Examples in which carbon black is used have a very low level of triboelectric charges even when combined with any of the chargeable control agents used in Examples, so that they cannot continuously give excellent fixed images as in the toners of Examples.

According to the present invention, there can be provided a toner having excellent stability and initial rise in the triboelectric charges, thereby continuously giving an excellent fixed image without generating deterioration in the image quality even when the toner is applied to a high-speed machine for a two-component development or to a developing device for a nonmagnetic monocomponent development.

What is claimed is:

1. A toner comprising:

(A) a resin binder, (B) a black colorant consisting essentially of a composite oxide of two or more metals, the composite oxide being contained in an amount of 1 to 40 parts by weight, based on 100 parts by weight of the resin binder, and at least one metal constituting the composite oxide is selected from the group consisting of Mg, Al, Ti, Mn, Fe and Cu, (C) a charge control agent comprising a quaternary ammonium salt, the quaternary ammonium salt being contained in an amount of 0.01 to 5 parts by weight, based on 100 parts by weight of the resin binder, and the quaternary ammonium salt is a compound represented by formula (Ib):

(1b)

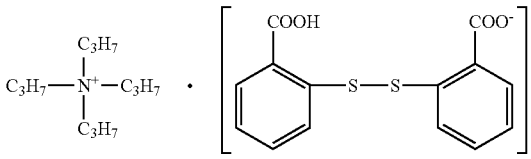

and (D) a metal-containing azo dye and/or a metal complex of an aromatic hydroxycarboxylic acid as a negatively charge control agent, wherein the toner is free of carbon black.

2. The toner according to claim 1, further comprising a nigrosine dye as a positively charge control agent.

3. The toner according to claim 2, wherein the nigrosine dye is contained in an amount of 0.2 to 5 parts by weight, based on 100 parts by weight of the resin binder.

4. The toner according to claim 1, wherein the composite oxide has an average particle size of 2 nm to 1 μm.

5. The toner according to claim 1, wherein the resin binder comprises a polyester as a major component.

6. The toner according to claim 5, wherein the polyester is a resin obtainable by polycondensing an alcohol component containing a compound represented by the formula (IV):

(IV)

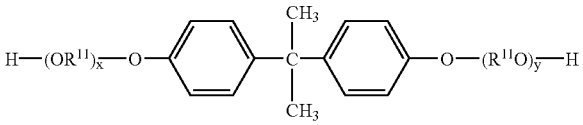

wherein $R^{11}$ is an alkylene group having 2 or 3 carbon atoms; each of x and y is a positive number, wherein a sum of x and y is 1 to 16, with a carboxylic acid component.

7. The toner according to claim 1 further comprising a low-melting point wax.

8. A toner comprising:

(A)a resin binder, (B) a black colorant consisting essentially of a composite oxide of two or more metals, and at least one metal constituting the composite oxide is selected from the group consisting of Mg, Al, Ti, Mn, Fe and Cu, (C) a charge control agent comprising a quaternary ammonium salt of the formula (Ib):

(1b)

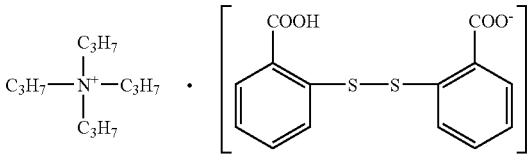

and (D) a metal-containing azo dye and/or a metal complex of an aromatic hydroxycarboxylic acid as a negatively charge control agent, wherein the toner is free from carbon black.

9. The toner according to claim 8, wherein the metal-containing azo dye is contained in an amount of 0.1 to 5 parts by weight, based on 100 parts by weight of the resin hinder.

10. The toner according to claim 8, wherein the metal complex of an aromatic hydroxycarboxylic acid is contained in an amount of 0.1 to 10 parts by weight, based on 100 parts by weight of the resin binder.

11. A toner consisting essentially of:

(A) a resin binder, (B) a black colorant consisting essentially of a composite oxide of two or more metals, the composite oxide being contained in an amount of 1 to 40 parts by weight, based on 100 parts by weight of the resin binder, and at least one metal constituting the composite oxide is selected from the group consisting of Mg. Al, Ti, Mn, Fe and Cu, (C) a charge control agent comprising a quaternary ammonium salt, the quaternary ammonium salt being contained in an amount of 0.01 to 5 parts by weight, based on 100 parts by weight of the resin binder, and the quaternary ammonium salt is a compound represented by formula (Ib):

(1b)

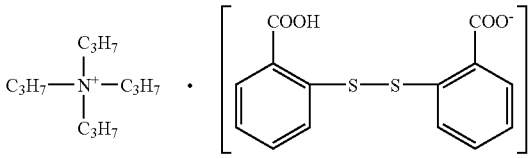

and (D) a metal-containing azo dye and/or a metal complex of an aromatic hydroxycarboxylic acid as a negatively charge control agent.

12. A toner consisting essentially of:

(A) a resin binder, (B) a black colorant consisting essentially of a composite oxide of two or more metals, the composite oxide being contained in an amount of 1 to 40 parts by weight, based on 100 parts by weight of the resin binder, and at least one metal constituting the composite oxide is selected from the group consisting of Mg, Al, Ti, Mn, Fe and Cu, (C) a charge control agent comprising a quaternary ammonium salt, the quaternary ammonium salt being contained in an amount of 0.01 to 5 parts by weight, based on 100 parts by weight of the resin binder, and the quaternary ammonium salt is a compound represented by formula (Ib):

(1b)

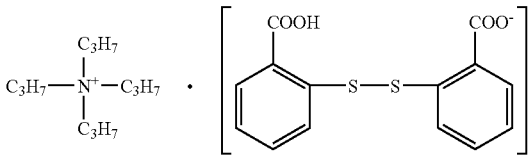

and (D) a metal-containing azo dye and/or a metal complex of an aromatic hydroxycarboxylic acid as a negatively charge control agent, wherein the toner is free of carbon black.

13. The toner according to claim 1, 8, 11 or 12, wherein the quaternary ammonium salt charge control agent is contained in an amount of from 0.5 to 2 parts by weight, based on 100 parts by weight of the resin binder.

14. The toner according to claim 1, 8, 11 or 12, wherein the composite oxide is contained in an amount of from 2.5 to 30 parts by weight, based on 100 parts by weight of the resin binder.

* * * * *